United States Patent [19]

Fukuzawa et al.

[11] Patent Number: 4,998,861

[45] Date of Patent: Mar. 12, 1991

[54] DRAINAGE PUMP

[75] Inventors: Sooichi Fukuzawa; Kazuyuki Yano, both of Hitachi, Japan

[73] Assignee: Hitachi, Ltd., Tokyo, Japan

[21] Appl. No.: 446,587

[22] Filed: Dec. 6, 1989

[30] Foreign Application Priority Data

Dec. 16, 1988 [JP] Japan ..... 63-319212

[51] Int. Cl.[5] ..... F04D 29/42

[52] U.S. Cl. ..... 415/206; 416/223 B

[58] Field of Search ..... 415/203, 206, 225, 121.2; 416/223 B

[56] References Cited

U.S. PATENT DOCUMENTS

| | | | |
|---|---|---|---|
| 3,044,408 | 7/1962 | Mellott | 415/206 |
| 3,130,679 | 4/1964 | Sence | 415/225 |

FOREIGN PATENT DOCUMENTS

| | | | |
|---|---|---|---|
| 534355 | 1/1955 | Belgium | 415/225 |
| 338186 | 11/1920 | Fed. Rep. of Germany | 415/206 |
| 1046502 | 12/1958 | Fed. Rep. of Germany | 415/206 |
| 1528684 | 1/1970 | Fed. Rep. of Germany | 415/225 |
| 2140588 | 2/1973 | Fed. Rep. of Germany | 415/225 |
| 2907432 | 9/1980 | Fed. Rep. of Germany | 415/185 |
| 43241 | 11/1972 | Japan . | |
| 41904 | 3/1977 | Japan | 415/121.1 |
| 47204 | 11/1978 | Japan . | |
| 131101 | 10/1979 | Japan . | |
| 19994 | 2/1984 | Japan . | |

*Primary Examiner*—John T. Kwon

*Attorney, Agent, or Firm*—Antonelli, Terry, Stout & Kraus

[57] ABSTRACT

A drainage pump includes a pump casing having an inlet and an outlet, and an impeller accommodated in the casing and rotated by a driving motor. The impeller has a plate-like vane. A liquid flows from the inlet toward a front end portion of the vane along the axis of the vane, and is discharged from the outlet in a direction substantially perpendicular to the axis of the vane. The front end portion of the vane has a convex shape, and therefore has an inclined portion which extends from a portion located on the axis of the vane to an outer peripheral edge thereof.

7 Claims, 4 Drawing Sheets

DRAINAGE PUMP

BACKGROUND OF THE INVENTION

The present invention relates to a drainage pump for use in an electric washing machine, and more particularly, to a drainage pump which is suitable for use in draining a liquid containing elongated fibers such as thread waste or cloth waste.

Conventional drainage pumps have been disclosed in the specifications of, for example, Japanese Patent Laid-Open Publication No. 54-131101, Japanese Patent Publication No. 47-43241, Japanese Utility Model Publication No. 53-47204, Japanese Utility Model Laid-Open Publication No. 59-19994 and U.S. Pat. No. 3,130,679.

However, in each of the drainage pumps of the above-described type, when a liquid containing elongated fibers such as thread waste, which have a small specific gravity is drained, the fibers tend to attach onto vanes of an impeller or to gather at a center of the vanes. It is difficult to remove the fibers from the vanes and to discharge them from the pump. Furthermore, such thread waste gathers in a clearance between the impeller and a casing of the pump thereby disabling the rotation of the vanes.

SUMMARY OF THE INVENTION

An object of the present invention is to provide a drainage pump which is suitable for use in draining a liquid containing elongated fibers such as thread waste having a small specific gravity, which has a simple structure, and which facilitates maintenance.

To this end, the present invention provides a drainage pump which includes a pump casing having an inlet and an outlet, and an impeller accommodated in the casing and rotated by a driving motor. The impeller has a first plate-like vane. The liquid flows from the inlet toward the front end portion of the first vane along an axis of first vane of the impeller, and is discharged from the outlet in a direction substantially perpendicular to the axis of the first vane. The front end portion of the first vane has a convex shape, and has an inclined portion which extends from the axis of the vane to an outer peripheral edge thereof.

In the present invention, the cloth waste or the like, which has a small specific gravity and which would gather at the center of the vane due to the vortex of the liquid located between the casing and the vane, is forcibly diffused toward the peripheral portion of the vane from the central portion thereof.

Also, when the cloth waste having a small specific gravity may attach onto the front end portion of the vane of the drainage pump, such cloth waste or the like is moved toward the peripheral of the vane (in the direction perpendicular to the rotation axis of the impeller) due to the centrifugal force generated by the rotation of the vane. More specifically, since the front end portion of the vane is formed so as to be inclined such that the vane is highest at the central portion thereof and that the height thereof gradually decreases toward the outer periphery thereof, the cloth waste which attaches the front end portion of the vane moves toward the outer peripheral portion of the vane and readily leaves therefrom.

Furthermore, since the vane accommodated in the pump casing consists of only one vane, no elongated thread waste is caught across one vane member and an adjacent one.

More specifically, no elongated thread waste is caught across the adjacent vane members which are disposed crosswise, and accordingly the thread waste can be therefore moved toward the outer periphery of the vanes readily.

DETAILED DESCRIPTION OF THE INVENTION

Figure 1:
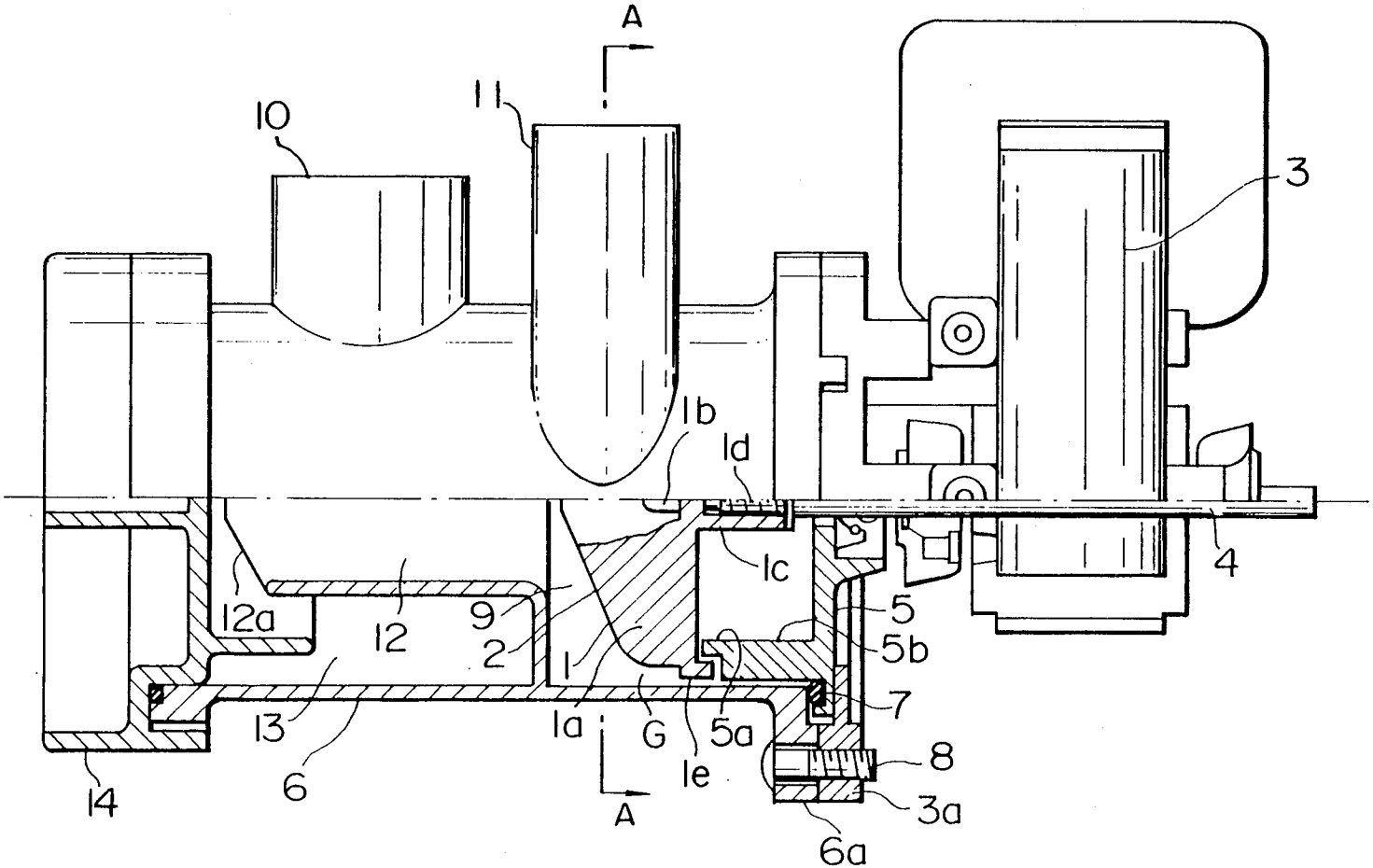
FIG. 1 is a front view, with part in cross-section, of a first embodiment of the present invention.
Figure 2:
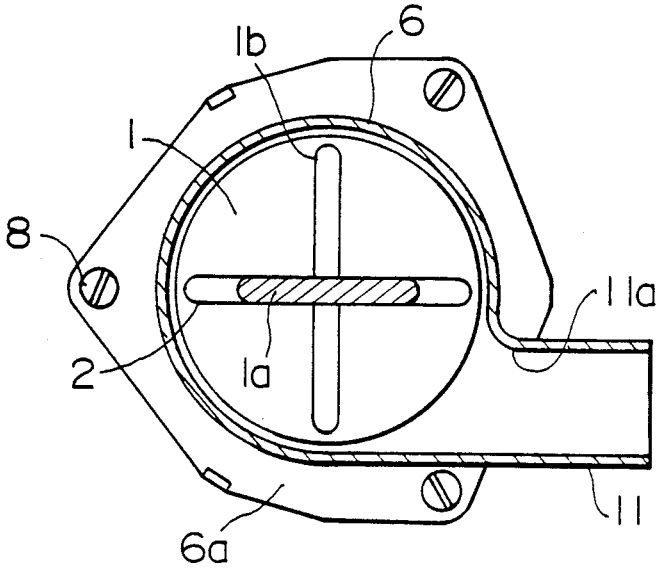
FIG. 2 is a cross-section of the essential parts of the embodiment of FIG. 1, which is taken along the line A—A of FIG. 1.

Referring first to FIG. 1, a drainage pump has an impeller 1 having a first vane 1*a*. The vane 1*a* has an inclined portion 2 which is the highest at the end portion thereof located on the axis of the impeller and which gradually becomes lower toward the outer periphery thereof, and the vane 1*a* is thereby formed in a convex shape. The impeller 1 also has a second vane 1*b* which has a smaller height than the first vane 1*a* and which is disposed such that it intersects the first vane 1*a* at right angle. The impeller 1 also has a boss portion 1*c* having a threaded portion 1*d* through which the impeller 1 is fixed to a driving shaft 4 of a motor 3. That is, the first vane incorporates the threaded portion for fixing the first vane to the impeller. A seal retaining portion 5 has a rising portion 5*b* and a projecting portion 5*a*. The seal retaining portion 5, together with a projection le formed on the impeller 1, forms a labyrinth packing. Part of the seal retaining portion 5 is gripped by a collar 3*a* of the motor 3 and a flange portion 6*a* of the pump casing 6, and is fixed by means of a screw 8 through a packing 7. A first chamber 9 is formed between the front end surface of the impeller 1 and the inner wall of the pump casing 6. A length of the first chamber formed by a front end portion of the first vane and the casing in an axial direction thereof increases as it separates from the axis. A swirling stream of water containing cloth waste or the like is generated in the first chamber 9 during the operation of the pump. The water is discharged from a fluid discharging pipe 11. The fluid (water) containing foreign matter is sucked into the pump from a fluid sucking pipe 10 connected to a pipe (not shown). A fluid sucking passage 12 has an inclined opened portion 12*a* at the end thereof. A second chamber 13 is formed between the outer wall of the fluid sucking passage 12 and the inner wall of the pump casing 6. The pump is closed by a lid 14. The second chamber 13, the inclined opened portion 12*a* of the fluid sucking passage 12, and the lid 14 of the pump in combination form a trap which catches the foreign matter which enters the casing 6. In FIG. 2, an inner edge portion of a connecting portion which connects the pump casing to the outlet is arcuate. That is, the arcuate portion 11*a* is formed at the portion which connects the fluid discharge pipe 11 to the casing 6 to allow cloth waste or the like to be prevented from being caught.

In the drainage pump arranged in the above-described manner, once the motor 3 is started and the impeller 1 is thereby rotated after the pump casing 6 has been filled with water, the water containing the foreign matter such as cloth waste or the like enters the second chamber 13 of the casing 6 from the fluid sucking pipe 10, and large foreign matter is caught. The water containing cloth waste or the like having a small specific gravity in turn flows into the fluid sucking passageway 12 then reaches the vane 1*a*, by means of which it is subjected to pumping action, i.e., a centrifugal force, and is thereby directed toward the first chamber 9 so that it is discharged from the fluid discharge pipe 11.

In embodiment FIGS. 1 and 2, the first vane (main vane) 1*a* and the second vane (auxiliary vane) 1*b*, which are disposed adjacent to each other, have different heights. That is, the first vane has a second vane mounted coaxially to the first vane, and the second vane is shorter in an axial direction thereof than the first vane. Furthermore, at least the front end portion of the first vane 1*a* having a larger height has an inclined portion which is the highest at the end located on the axis of the impeller and which gradually becomes lower toward the periphery of the vane. The first vane 1*a* therefore has a convex form. Consequently, the top of the front end portion of the first vane is located substantially at the center of the vortex generated in the pump, causing the cloth waste or the like having a small specific gravity to gather in the vicinity of the top of the front end portion. However, such cloth waste or the like is forcibly diffused toward the periphery of the vane due to the stirring action generated by the inclined portion of the first vane, and therefore prevented from staying and gathering at the center of the vortex so as to prevent clogging, which would occur after a long use in a conventional drainage pump in which the center of a vane is recessed.

Furthermore, the cloth waste or the like having a small specific gravity, which are attached to the main vane 1*a* of the impeller 1, moves toward the outer end of the vane due to the centrifugal force generated by the rotation of the main vane 1*a*. As stated above, since the main vane 1*a* has the inclined portion 2, such cloth waste or the like attached peels off from the main vane smoothly and moves toward the periphery thereof into the first chamber 9. Moreover, since the main vane 1*a* and the auxiliary vane 1*b* have different heights, as stated above, elongated thread waste or the like is prevented from being caught across one of the vane members and the adjacent another vane member. In the conventional drainage pump, however, the vanes readily are problematical because they are not given the above-described consideration. The thread waste which is caught across the adjacent vanes would not be readily moved toward the periphery of the vane. Furthermore, thread waste would gather in a pile in the gap between the vanes and the pump casing, thereby causing locking of the impeller in a long run. However, in this embodiment, since the main vane 1*a* and the auxiliary vane 1*b* have different heights, as stated above, elongated thread waste or the like can be prevented from being caught across one of the vane members and the adjacent another vane member, and locking of the impeller due to the cloth waste or the like caught between the vane and the pump casing can be thus prevented. Consequently, maintenance of the drainage pump can be eliminated.

In FIG. 1, when a clearance G between the outer periphery of the main vane 1*a* and the pump casing 6 is small, the water, which would be forced toward the casing 6 by means of the centrifugal force of the main vane 1*a*, is directed toward the first chamber 9, allowing the cloth waste or the like attached on the main vane 1*a* to readily peel off and to move into the first chamber 9. It has been experimentally determined, when the clearance G was set to a value which was 0.2 times the diameter of the main vane 1*a* or less, the cloth waste or the like attached on the main vane 1*a* peeled off excellently. Furthermore, since the first chamber 9 is formed such that the length thereof in the axial direction increases as it separates away from the axis of the impeller, the water which flows into the first chamber 9 can be effectively prevented from flowing back.

Figure 3A:
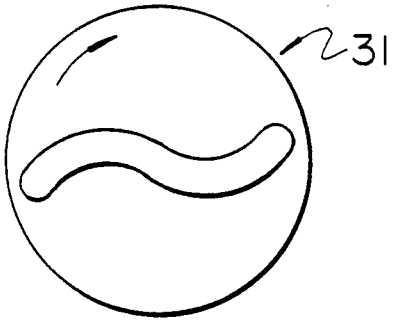
FIGS. 3A and 3B are respectively plan and front views of a second embodiment of the present invention.
Figure 3B:
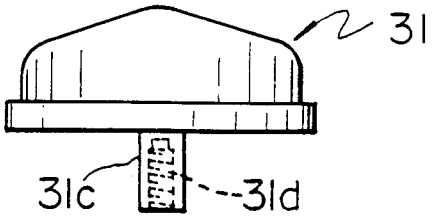

In the embodiment of FIGS. 3A and 3B, the vane of an impeller 31 has a form which consists of two curves exhibiting a point symmetry, as viewed in the direction in which a fluid flows in the pump casing. In this case, the impeller 31 does not have an auxiliary vane 1*b*, unlike the case of the embodiment of FIGS. 1 and 2, and the pumping effect is therefore slightly degraded when compared with the first embodiment. However, the degree of degradation is small, and smooth removal of the cloth waste or the like is assured, as in the case of the embodiment of FIGS. 1 and 2. A threaded portion 31C with an internal thread 31*d* is provided for fixing the impeller 31.

Figure 4A:
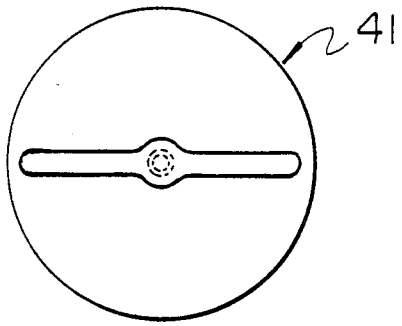
FIGS. 4A and 4B are respectively plan and front views of a third embodiment of the present invention.
Figure 4B:
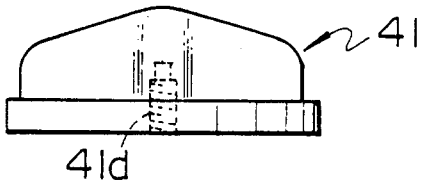

In the embodiment of FIGS. 4A and 4B, a threaded portion 41*d* for fixing the impeller is incorporated in the vane of an impeller 41. In this way, the overall size of the pump can be made small.

Figure 5:
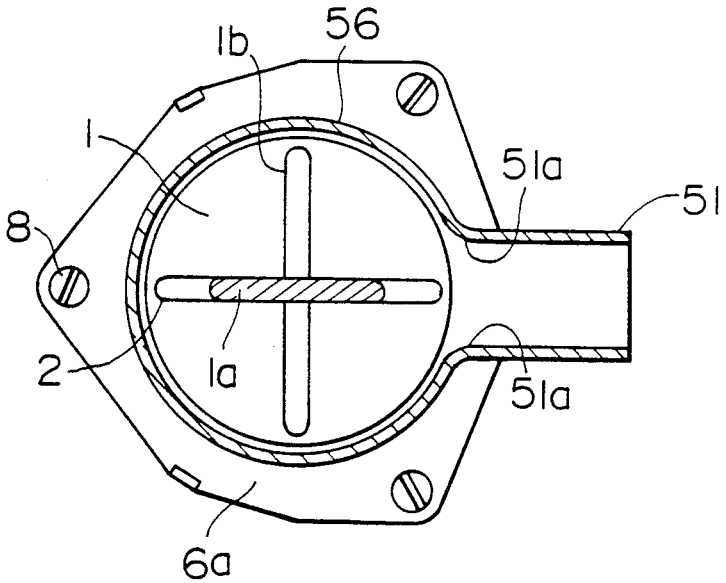
FIG. 5 is a cross-sectional view of a fourth embodiment of the present invention.

In the embodiment of FIG. 5, a fluid discharge pipe 51 is connected to a pump casing 56 in such a manner that the axis of the discharge pipe intersects the axis of the main vane 1*a* at right angle. This allows connecting portions 51*a* between the fluid discharge pipe 51 and the casing 56 to have a large angle, resulting in a reduction in the attached cloth waste or the like on these connecting portions 51*a*. Furthermore, the same pumping action and the same cloth waste removal effect are assured when the impeller 1 is rotated in opposite directions.

Figure 6:
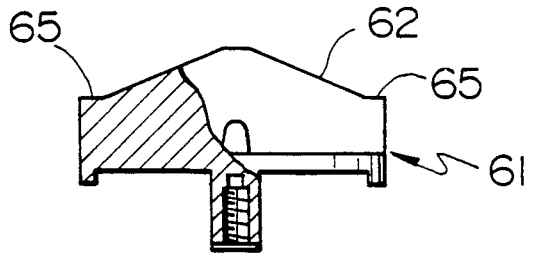
FIG. 6 is a front view of a fifth embodiment of the present invention.

In the embodiment of FIG. 6, a first vane 61 differs from that of the first embodiment in that a front end portion 62 thereof has at its periphery a vertical portion 65 which extends perpendicular to the axis of the first vane 61. In the embodiment of FIG. 6, the cloth waste or the like, which slips down along an inclined portion 62 toward the periphery of the vane, can also be pushed by inertia toward the pump casing in spite of the presence of the vertical portion 65, and the same cloth waste removal effect can be thus assured.

Figure 7:
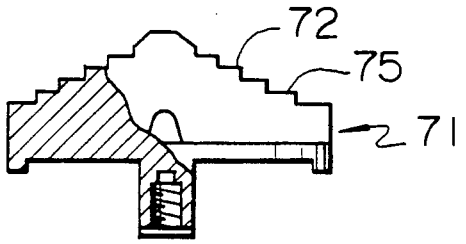
FIG. 7 is a front view of a sixth embodiment of the present invention.

In the embodiment of FIG. 7, a main vane 71 differs from that of the first embodiment in that an inclined portion 72 thereof has a plurality of stages 75. The embodiment of FIG. 7 also assures the same effect as that achieved by either of the aforementioned embodiments.

Figure 8:
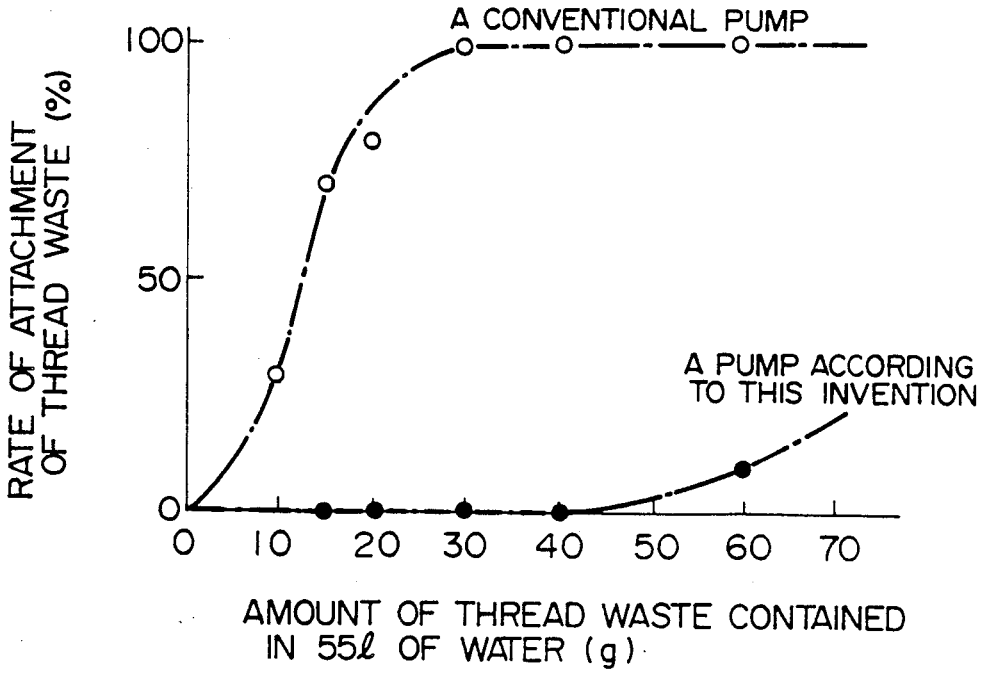
FIG. 8 is a graph, showing the performance curve of the drainage pump according to the present invention.

In FIG. 8, the abscissa represents the amount of thread waste contained in 55 l of water, and the ordinate represents the rate of attachment of thread cloth or the like on the drainage pump. For example, 10% of this rate was obtained when there was attached thread waste in one of the tests which were conducted 10 times in total.

What is claimed is:

1. A drainage pump comprising:

a pump casing having an inlet and an outlet; and an impeller accommodated in said casing and adapted to be rotated by a driving motor, said impeller having a first plate-like vane, and a second vane mounted coaxially to said first vane, said second vane has an axial length shorter than an axial length of said first vane, wherein a liquid flows from said inlet toward a front end portion of said first vane along an axis of said first vane, and is discharged to said outlet in a direction substantially perpendicular to the axis of said first vane, and wherein said front end portion of said first vane is formed in a convex shape so as to have an inclined portion which extends from a portion located on the axis of said vane to an outer peripheral edge thereof.

2. A drainage pump according to claim 1, wherein said first vane includes two curves having a point of symmetry in a diametric section thereof.

3. A drainage pump according to claim 1, wherein said first vane includes a threaded portion for fixing said first vane to a shaft.

4. A drainage pump according to claim 1, wherein said first vane, has at a periphery of said front end portion thereof, a vertical portion which extends perpendicular to an axis of said first vane.

5. A drainage pump according to claim 1, wherein said first vane includes a plurality of stages on said inclined portion thereof.

6. A drainage pump comprising:

a pump casing having an inlet and an outlet; and an impeller accommodated in said casing and adapted to be rotated by a driving motor, said impeller having a first plate-like vane, said first vane having at a periphery of a front end portion thereof a vertical portion which extends perpendicular to an axis of said first vane, wherein a liquid flows from said inlet toward the front end portion of said first vane along an axis of said first vane, and is discharged to said outlet in a direction substantially perpendicular to the axis of said first vane, and wherein said front end portion of said first vane is formed in a convex shape so as to have an inclined portion which extends from a portion located on the axis of said vane to an outer peripheral edge thereof.

7. A drainage pump comprising:

a pump casing having an inlet and outlet; and an impeller accommodated in said casing and adapted to be rotated by a driving motor, said impeller having a first plate-like vane, wherein a liquid flows from said inlet toward the front end portion of said first vane along an axis of said first vane, and is discharged to said outlet in a direction substantially perpendicular to the axis of said first vane, said front end portion of said first vane is formed in a convex shape so as to have an inclined portion which extends from a portion located on the axis of said vane to an outer peripheral edge thereof, and wherein said first vane has a plurality of stages on said inclined portion.

* * * * *